US007029087B2

(12) United States Patent
Tamura

(10) Patent No.: US 7,029,087 B2
(45) Date of Patent: Apr. 18, 2006

(54) HEAD DRIVING DEVICE OF LIQUID EJECTING APPARATUS

(75) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 222 days.

(21) Appl. No.: 10/651,082

(22) Filed: Aug. 29, 2003

(65) Prior Publication Data

US 2004/0119770 A1 Jun. 24, 2004

(30) Foreign Application Priority Data

Aug. 30, 2002 (JP) ..... P.2002-256187

(51) Int. Cl.
*B41J 29/38* (2006.01)
*B41J 29/393* (2006.01)

(52) U.S. Cl. ..... 347/17; 347/19
(58) Field of Classification Search ..... 347/17, 347/19, 14, 59
See application file for complete search history.

(56) References Cited

U.S. PATENT DOCUMENTS 5,635,968 A * 6/1997 Bhaskar et al. ..... 347/59
6,652,057 B1 * 11/2003 Masuda et al. ..... 347/14

FOREIGN PATENT DOCUMENTS

JP 2001-205796 A 7/2001

* cited by examiner

*Primary Examiner*—Thinh Nguyen
(74) *Attorney, Agent, or Firm*—Sughrue Mion, PLLC

(57) ABSTRACT

A head driving device of a liquid ejecting apparatus includes a plurality of nozzles, a head driving circuit generating driving signals, a plurality of pressure generating elements correspondingly provided for each of the nozzles, and applying pressure to liquid based on the driving signals so that liquid droplets are ejected from the nozzles, an integrated switching circuit selecting the driving signals for applying to the pressure generating elements at predetermined ejecting timing, a controller controlling a liquid ejecting operation, and a thermal detector provided in the integrated switching circuit, and detecting a temperature of the integrated switching circuit. The thermal detector outputs a digital signal to the controller when the temperature of the integrated switching circuit is increased to greater than a predetermined temperature.

9 Claims, 7 Drawing Sheets

HEAD DRIVING DEVICE OF LIQUID EJECTING APPARATUS

BACKGROUND OF THE INVENTION

The present invention relates to a head driving technique, for a liquid ejecting apparatus, that detects an increase to a predetermined temperature at a switching circuit IC, which sequentially switches and drives pressure generating elements provided for corresponding nozzles through which liquid droplets are ejected, and that halts a liquid ejecting operation.

The liquid ejecting device is used as a record apparatus used with an image record apparatus, a color material ejecting apparatus used for manufacturing a color filter of a liquid crystal display, etc., an electrode material (conductive paste) ejecting apparatus used for electrode formation of an organic EL display, an FED (face light emitting display), etc., a bioorganic substance ejecting apparatus used for biochip manufacturing, a specimen ejecting apparatus as a precision pipet, etc. One form of the liquid ejecting devices will be discussed by taking an ink jet printer as an example.

Ink jet color printers, used for the ejection from recording heads of several colors of ink, have become popular as output apparatuses for computers, and have been employed for the printing, using multiple colors and tones, of images processed by the computers.

For example, in an ink jet printer using a plurality of piezoelectric elements as driving elements, the piezoelectric elements corresponding a plurality of nozzles of a print head, are selectively driven, and ink droplets are ejected from the nozzles in accordance with the drive voltages applied to the individual piezoelectric elements, thereby the ink droplets are deposited as dots on a printing sheet for printing.

The piezoelectric elements are corresponded to the nozzles for ejecting ink droplets. The ink droplets are ejected based on drive signals supplied by at least one head driver IC mounted in the print head.

This type of head driving device is shown in FIG. 6. In FIG. 6, a head driving device 1 includes piezoelectric elements 2, a drive waveform generating circuit 3, current amplifier circuits 4 and switch circuits 5. Each of the piezoelectric elements 2 is provided so as to correspond with each of a plurality of nozzles of an ink jet printer. The drive waveform generating circuit 3 supplies a drive signal to an electrode 2*a* of each of the individual piezoelectric elements 2. One each of the current amplifier circuits 4 and the switch circuits 5 is located between the drive waveform generating circuit 3 and each piezoelectric element 2.

While only one piezoelectric element 2 is shown in FIG. 6, since a plurality of nozzles are provided in the head of an ink jet printer, a plurality of piezoelectric elements are supplied, one for each of the nozzles. A drive signal COM, generated by the drive waveform generating circuit 3, is sequentially output, through a shift register, to each of the piezoelectric elements 2.

The piezoelectric elements 2 can be displaced by voltages applied to electrodes 2*a* and 2*b*. Further, a charge, at a level near the intermediate potential, is constantly applied to the piezoelectric elements 2. When a discharge is initiated based on the drive signal COM supplied by the drive waveform generating circuit 3, ink droplets are ejected by applying pressure on the ink supplied for corresponding nozzles.

The drive waveform generating circuit 3 generates the drive signal COM that is transmitted to the head of the ink jet printer. The drive waveform generating circuit 3 may be located in either the printer main body or the printing head.

The current amplifier circuit 4 includes two drive devices, i.e., first and second transistors 4 and 4*b*. For the first transistor 4*a*, the collector is connected to a constant voltage power source, the base of which is connected to a first output terminal of the drive waveform generating circuit 3, and the emitter of which is connected to the input terminal of the switch circuit 5. With this arrangement, upon the reception of the drive signal COM from the drive waveform generating circuit 3, the first transistor 4*a* is rendered active and transmits a charge current through the switching circuit 5 to the piezoelectric element 2.

For the second transistor 4*b*, the emitter is connected to the input terminal of the switching circuit 5, the base of which is connected to a second output terminal of the drive waveform generating circuit 3, and the collector of which is grounded. With this arrangement, upon the reception of a drive signal COM from the drive waveform generating circuit 3, the second transistor 4*b* discharges the piezoelectric element 2 through the switching circuit 5.

Based on a control signal, the switching circuit 5 is turned on at the timing whereat a corresponding piezoelectric element 2 is driven, and outputs the drive signal COM to this piezoelectric element 2. The switching circuit 5 is actually a so-called transmission gate that turns a corresponding piezoelectric element 2 on or off, and is integrated to serve as the switching circuit IC 6.

For the thus arranged head driving device 1, the switching circuit ICs 6, constituting the switching circuits 5, generate heat as they are activated, and this heat is discharged by the ejection of ink droplets from the piezoelectric elements 2, or through the part that constitutes the head. However, due to the continuous driving operation, or the exhaustion of ink, the satisfactory discharge of heat through ink ejection will not be performed.

When in this state printing is continued, the temperature of each switching circuit IC 6 is increased, and thermal destruction of the switching circuit IC 6 and the piezoelectric element may occur. Therefore, for the related ink jet printer 1, based on the fact that the anode voltage of a diode 7, which is provided for each switching circuit IC 6, is changed in accordance with a temperature of each switching circuit IC 6, the anode voltages of the diodes 7*a*, 7*b*, 7*c* and 7*d* in the switching circuit ICs 6*a*, 6*b*, 6*c* and 6*d* are transmitted through cables 8*a*, 8*b*, 8*c* and 8*d* to a controller 9 that is arranged in the printer as an ASIC.

In the controller 9, the anode voltages of the switching circuit ICs 6*a*, 6*b*, 6*c* and 6*d* are converted into digital values by an AD converter 9*a* to detect the anode voltages of the diodes 7*a*, 7*b*, 7*c* and 7*d* of the switching circuit ICs 6*a*, 6*b*, 6*c* and 6*d*. The temperatures of the switching circuit ICs 6*a*, 6*b*, 6*c* and 6*d* are detected based on the anode voltages.

When a predetermined temperature or higher is detected for the switching circuit IC 6*a*, 6*b*, 6*c* or 6*d*, the controller 9 temporarily halts the printing operation to reduce the temperature of the pertinent switching circuit IC 6. Also, when the ink is exhausted, the controller 9 halts the printing operation until an ink cartridge exchange is performed.

However, since the controller 9 performs AD conversions for the anode voltages of the switching circuit ICs 6*a*, 6*b*, 6*c* and 6*d*, a long processing time is required to detect the temperatures of the switching circuit ICs 6*a*, 6*b*, 6*c* and 6*d*. Accordingly, there is a comparative reduction in the accuracy of the temperature measurement, and until the next temperature measurement can be made, a large, estimated value must be employed as a temperature rise. Therefore, the ON resistances of the analog switches for the switching circuits 5 in the switching circuit ICs 6*a*, 6*b*, 6*c* and 6*d* must be reduced.

When the ON resistance of each analog switch is small, the sizes of the switching circuit ICs 6*a*, 6*b*, 6*c* and 6*d* are increased, and the manufacturing costs are also raised.

Further, since comparatively long connection cables extend from the switching circuit ICs 6*a*, 6*b*, 6*c* and 6*d* to the controller 9, and since analog signals transmitted through these cables tend to be adversely affected by noise, the detection accuracy is reduced.

Furthermore, the AD converter 9*a* provided on the controller 9 is required, since the AD converter 9*a* converts the anode voltages of the switching circuit ICs 6*a*, 6*b*, 6*c* and 6*d* into digital signals. Therefore, the size of the controller 9 constituted by an ASIC is increased.

SUMMARY OF THE INVENTION

It is therefore an object of the present invention to provide a head driving device having a simple configuration, wherein the temperature of a switching circuit IC can be accurately measured without being affected by noise, and the controller arrangement can be simplified.

To achieve this objective, according to the invention, each time a printing pass is started, a temperature detector compares the anode voltage of the diode of a switching circuit IC with a reference value. When the anode voltage of the diode drops below the reference value, the temperature detector detects that the temperature of the switching circuit IC has reached a predetermined temperature and transmits a digital signal to the controller in a printer.

Specifically, according to the present invention, there is provided a head driving device of liquid ejecting apparatus, comprising:

a plurality of nozzles;

a head driving circuit, generating driving signals;

a plurality of pressure generating elements, correspondingly provided for each of the nozzles, and applying pressure to liquid based on the driving signals so that liquid droplets are ejected from the nozzles;

an integrated switching circuit, selecting the driving signals for applying to the pressure generating elements at predetermined ejecting timing;

a controller, controlling a liquid ejecting operation; and a thermal detector, provided in the integrated switching circuit, and detecting a temperature of the integrated switching circuit, wherein the thermal detector outputs a digital signal to the controller when the temperature of the integrated switching circuit is increased to greater than a predetermined temperature.

Preferably, a diode is provided in the integrated switching circuit; and wherein the thermal detector detects the temperature of the integrated switching circuit based on an anode voltage of the diode.

Preferably, the thermal detector detects the temperature of the integrated switching circuit each time a liquid ejecting of a pass is started.

In the above configuration, each time a liquid ejecting pass is started, the temperature detectors compare, with the reference value, the anode voltage of the diode of the integrated switching circuit. When the anode voltage of the diode is lower than the reference value, the temperature detector transmit digital signal to the controller of the liquid ejecting apparatus.

Therefore, when the controller obtains the digital signal from the temperature detector internally provided for the integrated switching circuit, the controller can detect, each time a liquid ejecting pass is started, that the temperatures of the integrated switching circuit IC has been raised to higher than the predetermined temperature.

Upon the reception of the digital signal from the temperature detector of the switching circuit, the controller ascertains that the temperature of the switching circuit is higher than the predetermined temperature, and based on this detection, temporarily halts or forcibly terminates the liquid ejecting operation. Or, when liquid is exhausted, the controller waits until the liquid cartridges have been exchanged. As a result, the switching circuit and the pressure generating element can be protected from thermal destruction due to the rise in the temperature.

Therefore, during the temperature detection process, the controller of the liquid ejecting apparatus need not perform the AD conversion of the signals received from the integrated switching circuit, and can quickly detect the temperature. Thus, even when the temperature detection process is performed each time a liquid ejecting pass is started during an interval between liquid ejecting operations, the throughput for the liquid ejecting operation is not reduced.

Since only a short time is required before the next temperature detection is performed, the controller can accurately detect the temperature of the switching circuit, the temperature rise until the next temperature detection can be estimated to be a small value, and large ON resistances can be set for the analog switch of the integrated switching circuit. Therefore, switching circuit having a smaller size can be made, at a lower cost.

In addition, since a temperature detection signal output by the integrated switching circuit to the controller is a digital signal, the signal is seldom adversely affected by noise, even when transmitted through a long cable extending from the integrated switching circuit to the controller, and the detection accuracy is increased.

Preferably, the controller halts the liquid ejecting operation, and defer a start of the halted liquid ejecting operation until the temperature of the integrated switching circuit is reduced to a specific temperature when the controller receives the digital signal.

Preferably, the temperature detector includes:

a temperature setting unit, setting a reference voltage that corresponds to a reference temperature of the integrated switching circuit; and a comparator, comparing the anode voltage of the diode with the reference voltage, and outputting the digital signal to the controller when the anode voltage of the diode is increased to greater than the reference voltage.

In the above configuration, since in the integrated switching circuit, the temperature setting unit sets an appropriate reference voltage, the comparator receives this reference voltage at one input terminal.

Under these conditions, at an interval between the liquid ejecting operations using a liquid ejecting head, i.e., at the start of a liquid ejecting pass, the comparator compares the anode voltage for the diode arranged in each switching circuit IC with the reference voltage set by the temperature setting unit.

When the anode voltage for the diode is higher than the reference voltage, the comparator does not output a digital signal, whereas when the anode voltage is lower than the reference voltage, the comparator outputs a digital signal to the controller.

In the above configuration, when the controller obtains the digital signals from the comparators of the integrated switching circuit, the controller can ascertain whether the temperatures of the integrated switching circuit is higher than the predetermined temperature.

Here, it is preferable that, a plurality of the integrated switching circuits are provided for each group of nozzles. The digital signals output from the comparators of the integrated switching circuits are independently transmitted to the controller.

In the above configuration, wherein digital signals are independently output, by the comparators of the integrated switching circuits to the controller, even when a failure, such as a disconnection, occurs along part of one of the cables extending from the integrated switching circuits to the controller, temperature detection is disabled only for the integrated switching circuit using the malfunctioning cable, and the temperatures of the integrated switching circuits using the other cables can be detected with no problem.

Here, it is preferable that, wherein the integrated switching circuit includes a FET. The digital signal output from the comparator is received at a gate of the FET. An output terminal of the FET is an open-drain.

In the above configuration, upon the reception, from the comparator, of a digital signal, the FET is turned on and a signal is output by the open-drain and is transmitted to the controller.

Here, it is preferable that, a plurality of the integrated switching circuits are provided for each group of nozzles. The digital signals output from the open-drains of the FETs of the integrated switching circuits are independently transmitted to the controller.

In the above configuration, wherein the digital signals are independently output by the FETs of the integrated switching circuits to the controller, even when a failure, such as a disconnection, has occurred along a part of one of the cables extending between the integrated switching circuits and the controller, temperature detection is disabled only for the integrated switching circuit using the malfunctioning cable, and the temperatures of the integrated switching circuits using the other cables can be detected with no problem.

Here, it is preferable that, a plurality of the integrated switching circuits are provided for each group of nozzles. The digital signals output from the open-drains of the FETs of the integrated switching circuits are combined as AND operation. The combined digital signal is transmitted through a single cable to the controller.

In the above configuration, wherein the digital signals for the FETs of the integrated switching circuits are output by the open-drains, when the outputs of the open-drains are ANDed, the digital signals output by the individual FETs are transmitted through the single cable to the controller, without interfering with each other. Therefore, since for temperature detection only one cable is required for a plurality of switching circuits, the manufacturing costs can be reduced. Further, for this arrangement, only a small number of input pins are required for the controller, and this contributes to a reduction in the number of pins required for the ASIC constituting the controller.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

A head driving device for an ink jet printer, according to one embodiment of the present invention, will now be described while referring to the accompanying drawings. It should be noted that the following embodiment is merely a preferred example for the invention, and that various preferred technical limitations are provided. However, the invention is not limited to this embodiment unless the limitations provided for the invention are specifically included in the following explanation.

Figure 1:
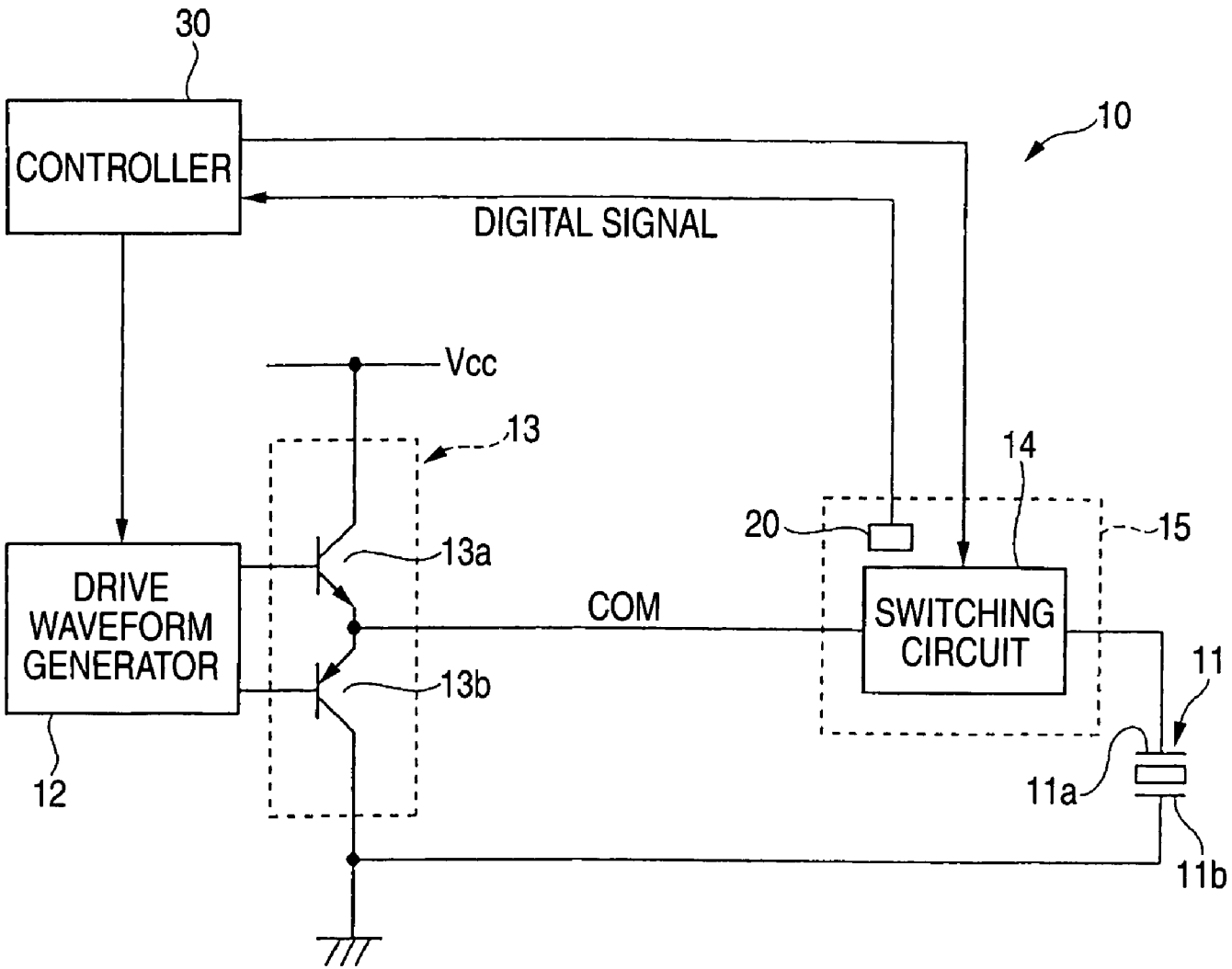
FIG. 1 is a block diagram showing the configuration of a head driving device according to one embodiment of the present invention.

FIG. 1 is a diagram showing the configuration of a head driving device for an ink jet printer according to the embodiment of the present invention. In FIG. 1, a head driving device 10 includes a plurality of piezoelectric elements 11, a drive waveform generating circuit 12, current amplifier circuits 13, switching circuits 14 for selecting nozzles, temperature detectors 20 and a controller 30 for a printer. Each of the piezoelectric elements 11 is provided so as to correspond with each of nozzles in the printing head of an ink jet printer. The drive waveform generating circuit 12 supplies a drive signal COM to an electrode 11*a* of each piezoelectric element 11. The current amplifier circuits 13 and the switching circuits 14 are arranged between the drive waveform generating circuit 12 and the piezoelectric elements 11. The temperature detectors 20 detects the temperatures of the switching circuits 14. The controller 30 controls the drive waveform generating circuit 12 and the switching circuits 14 based on detection signals received from the temperature detectors 20.

In FIG. 1, actually, one nozzle row for each color is provided on the printing head of the ink jet printer. The piezoelectric elements 11 are provided for these nozzle rows.

The piezoelectric elements 11 are displaced by the voltage applied to the electrodes 11*a* and 11*b*. When the piezoelectric elements 11 are discharged upon receiving the drive signal COM from the drive waveform generating circuit 12, the piezoelectric elements 11 apply pressure on the ink in corresponding nozzles thereby ink droplets are ejected from the nozzles.

The drive waveform generating circuit 12 generates the drive signal COM to be transmitted to the printing head of the ink jet printer. The drive waveform generating circuit 12 is located in a controller 15 within the printer main body or the printing head.

Each of the current amplifier circuits 13 includes first and second transistors 13*a* and 13*b*. The collector of the first transistor 13*a* is connected to a constant-voltage source Vcc, the base of which is connected to a first output terminal of the drive waveform generating circuit 12, and the emitter of which is connected to the input terminal of the switching circuit 14. With this structure, the first transistor 13*a* is rendered conductive, based on the drive signal COM received from the drive waveform generating circuit 12, and supplies a drive voltage waveform through the switching circuit 14 to the corresponding piezoelectric element 11.

The emitter of the second transistor 13*b* is connected to the input terminal of the switching circuit 14, the base of which is connected to a second output terminal of the drive waveform generating circuit 12, and the collector of which is grounded. With this structure, the second transistor 13*b* is rendered conductive, based on the drive signal COM received from the drive waveform generating circuit 12, and discharges the corresponding piezoelectric element 11 through the switching circuit 14.

When the switching circuits 14 receive a control signal from the controller 15 in the printer main body, the switching circuits 14 are turned on, at the drive timings for the corresponding piezoelectric elements 11, and output the drive signal COM to the piezoelectric elements 11. The switching circuits 14 are actually so-called transmission gates for turning on or off the piezoelectric elements 11, and are integrated to serve as the switching circuit ICs 15.

Figure 2:
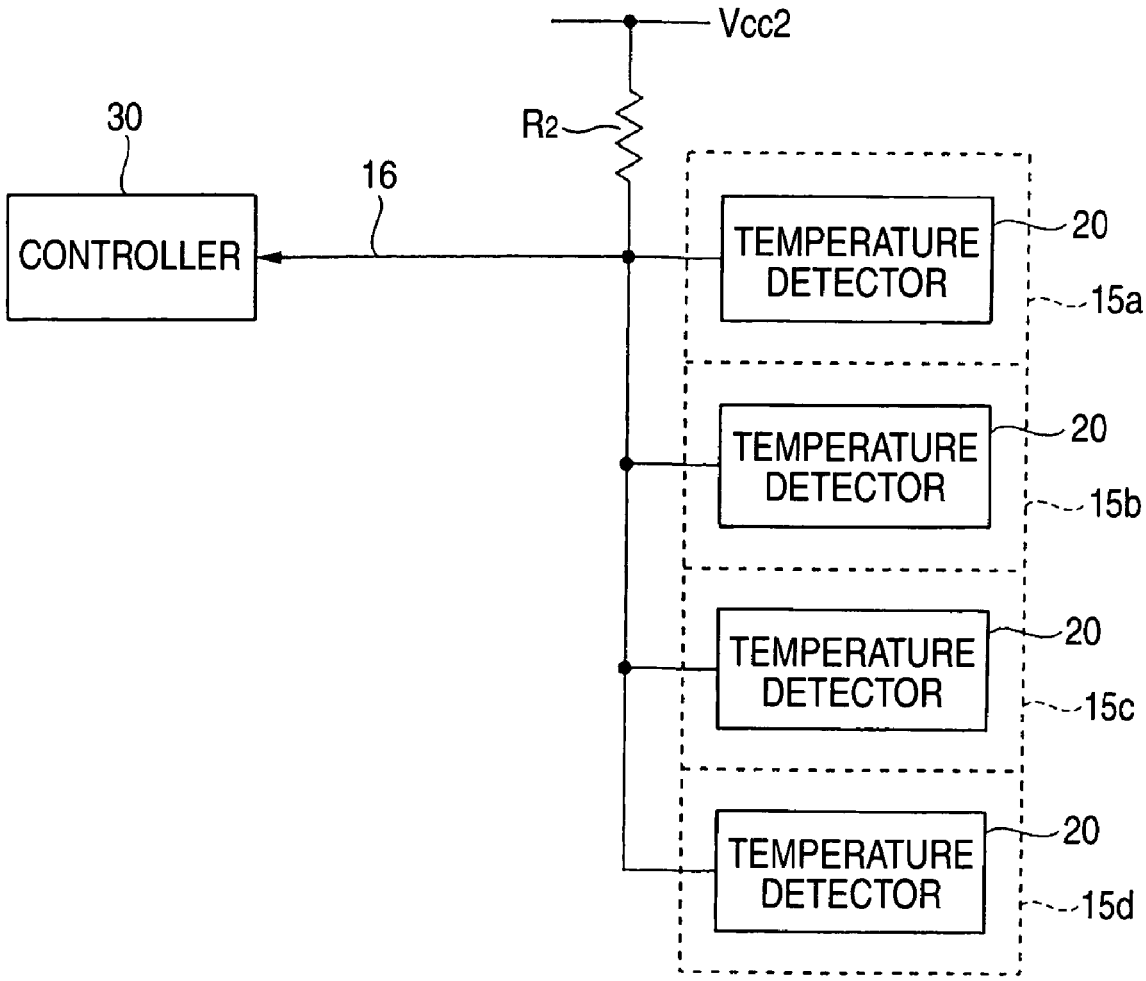
FIG. 2 is a schematic diagram showing the relationship between the temperature detector of each switching circuit IC and a controller in the head driving device in FIG. 1.

As is shown in FIG. 2, the temperature detectors 20 compare a reference voltage with the anode voltages of diodes included in a plurality (four in FIG. 2) of switching circuit ICs 15*a*, 15*b*, 15*c* and 15*d*, and digitize the comparison results, and output the digital signals through a single cable 16 to the controller 30 of the printer. The switching circuit ICs 15*a*, 15*b*, 15*c* and 15*d* are provided for corresponding nozzle arrays in the printing head of the ink jet printer.

The same arrangement is employed for the switching circuit ICs 15*a*, 15*b*, 15*c* and 15*d*, which selectively drive the piezoelectric elements corresponding to the nozzle arrays for colors such as yellow, magenta, cyan and black.

Figure 3:
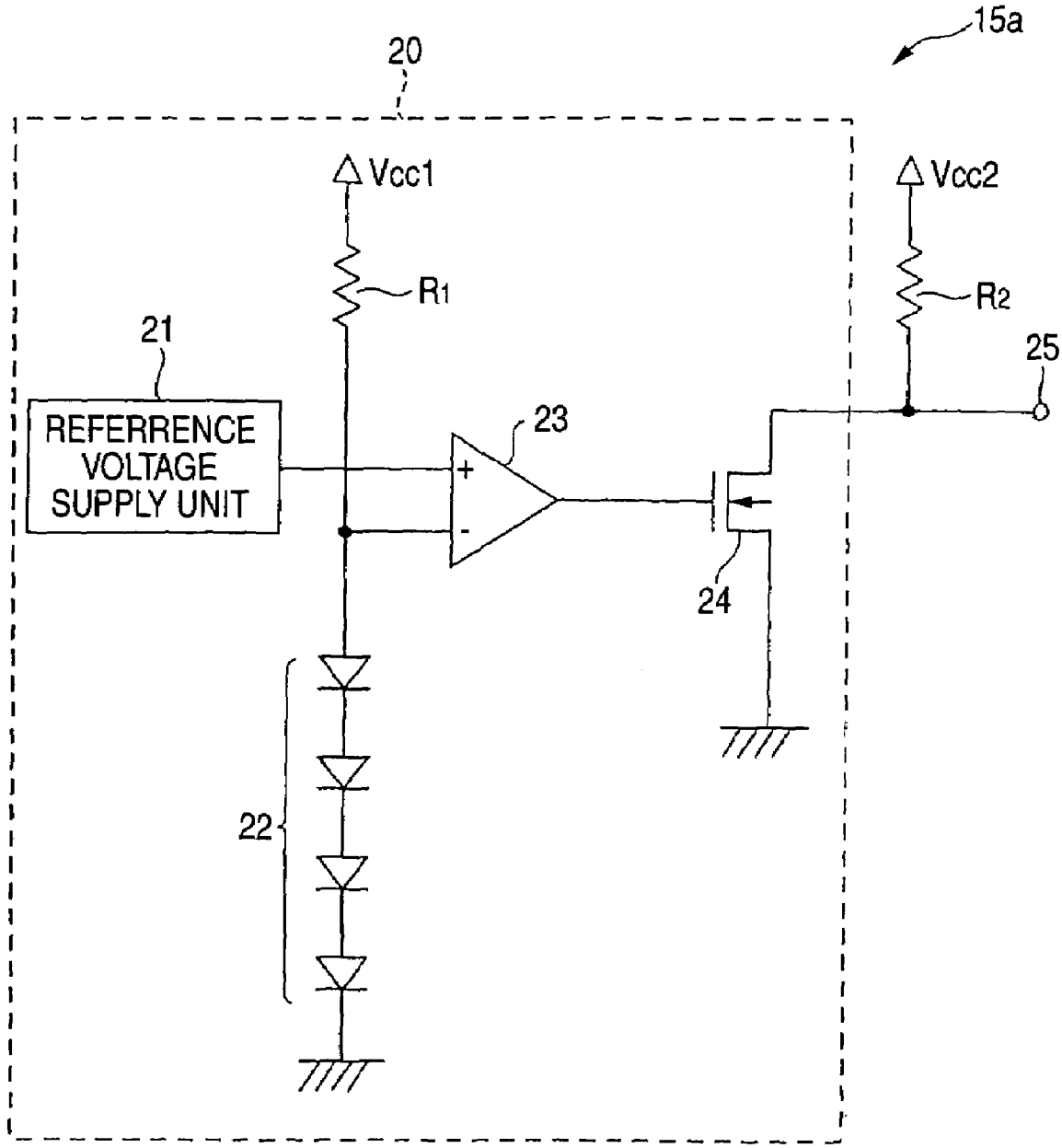
FIG. 3 is a block diagram showing the essential portion of the switching circuit IC in FIG. 2.

The arrangement of the switching circuit IC 15*a* will now be described. FIG. 3 is a block diagram showing the arrangement of the switching circuit IC 15*a*. In FIG. 3, the switching circuit IC 15*a* includes the temperature detector 20 disposed adjacent to the switching circuit 14 (not shown). The temperature detector 20 includes a reference voltage supply unit 21, a diode 22, a comparator 23 and a FET 24.

The reference voltage supply unit 21 is a direct-current power supply unit having an arbitrary structure, and sets a reference value Vref that corresponds to a reference temperature Tref used for temperature detection.

The reference temperature Tref is a threshold value lower than a rated temperature for a switching circuit IC. This threshold value is set so that it does not exceed the rated temperature, even when a temperature rise, due to one printing pass (e.g., solid printing, or all over printing) performed before the next temperature detection, has reached its maximum.

When relative to a rated temperature of 120° C., a temperature rise due to one performance of the printing operation is set at about 5° C., a setting of about 115° C. is required for the threshold value. However, since for detection accuracy a variance of ±15° C. is allowed for the temperature detector 20, actually, the threshold value is set at about 100° C.

The diode 22 is provided in the switching circuit IC 15*a*, and the anode of the diode 22 is connected to a constant voltage supply Vcc1 through a resistor R1, while the cathode is grounded. The diode 22 in FIG. 3 is a set of a plurality of diodes, such as four, connected in series. As will be described later, a characteristic of the anode voltage V of the diode 22 is that it is lowered as the temperature of the switching circuit IC 15*a* is raised.

The comparator 23 receives the anode voltage V of the diode 22 at the inverting input terminal, and receives the reference value Vref, from the reference voltage supply unit 21, at the non-inverting input terminal. Then, the comparator 23 compares the anode voltage V with the reference voltage Vref.

When the anode voltage V of the diode 22 is higher than the reference value Vref, the comparator 23 outputs a digital signal at level L. When the anode voltage V of the diode 22 is lower than the reference value Vref, the comparator 23 outputs a digital signal at level H.

The gate of the FET 24 is connected to the output terminal of the comparator 23, the source is grounded, and the drain is connected to a constant voltage supply Vcc2, through a resistor R2, and serves as an open-drain for outputting a digital signal.

When the output signal of the comparator 23 is at level L, the thus arranged FET 24 is OFF, the drain is maintained at the voltage of the constant voltage supply Vcc2, and an output signal XHOT, output at a terminal 25, goes to level H. When the output signal of the comparator 23 goes to level H, the FET 24 is turned on and the voltage at the drain is dropped to the ground potential. Thus, the output signal XHOT of the output terminal 25 goes to level L.

The controller 30, which is internally provided in the printer, generates print image data based on print data transmitted by a host computer, such as a personal computer, and drives the drive waveform generators 12 and the switching circuits 14 based on the print image data.

Each time a printing of a pass is started, the controller 30 permits the temperature detectors 20 to detect the temperatures of the corresponding switching circuit ICs 15. When the digital output signals XHOT of the temperature detectors 20 are at level H, the controller 30 assumes that the temperatures of the switching circuit ICs 15 constituting the switching circuits 14 are lower than a predetermined temperature, and drives the drive waveform generators 12 and the switching circuits 14 in the normal mode. Thus, the printing of the pass is performed.

On the other hand, when the digital output signals XHOT received from the temperature detectors 20 are at level L, the controller 30 assumes that the temperatures of the switching circuit ICs 15 for the switching circuits 14 are the predetermined temperature or higher, and halts the waveform generators 12 and the switching circuits 14 to temporarily halt or to forcibly terminate the printing operation. Therefore, the temperatures of the switching circuit ICs 15 are reduced, and the piezoelectric elements 11 can be protected from thermal destruction due to the rise in the temperature.

For this embodiment, the head driving device 10 performs the following operation. First, in each of the switching circuit ICs 15*a* to 15*d*, the reference value Vref set in advance by the reference voltage supply unit 21 is input to the non-inverting input terminal of the comparator 23 in the temperature detector 20.

The anode voltage V, corresponding to the switching circuit IC 15*a*, 15*b*, 15*c* or 15*d*, is generated at the diode 22. The comparator 23 compares the anode voltage V with the reference value Vref. When the anode voltage V is higher than the reference Vref, the comparator 23 outputs a signal at level L. In result, the FET 24 is maintained in the OFF state, the voltage of the constant voltage supply Vcc2 is applied to the output terminal 25, and the digital signal XHOT is output at level H by the output terminal 25.

When the temperature of the switching circuit IC 15*a* to 15*d* is raised, and the anode voltage V of the diode 22 drops below the reference value Vref, the comparator 23 outputs a signal at level H and the FET 24 is turned on. Therefore, the voltage at the output terminal 25 is reduced to the ground level, and the digital signal XHOT is output at level L from the output terminal 25.

For the switching circuit ICs 15*a* to 15*d*, as is shown in FIG. 3, the output terminals 25 of the FETs 24 are open-drains. Therefore, when the signals of the output terminals 25 performs AND operation, the signals do not interfere with each other, and when the FET 24 of a specific switching circuit IC 15 is turned on, the voltage at the output terminal 25 is reduced to the ground potential. As a result, the digital signal XHOT at the output terminal 25 goes to level L.

As is described above, when the temperature of a specific switching circuit IC 15 exceeds a predetermined temperature (a threshold value), the output of the corresponding comparator 23 goes to level H, and the digital signal XHOT transmitted by the open-drain of the FET 24 to the controller 30 goes to level L. Therefore, the controller 30 can detect that the temperature of the specific switching circuit IC has exceeded the predetermined temperature (the threshold value).

In this case, since the digital signals XHOT are transmitted by the switching circuits 15*a* to 15*d* through the single cable 16 to the controller 30, unlike in the related case, the AD conversion is not required for the anode voltages of the diodes 22.

Since the AD conversion is not required for the temperature detection, the processing time can be drastically shortened, so that the throughput is not reduced, even when the temperature detection is performed each time a printing of a pass is started.

In addition, an AD converter need not be provided, and a cable and an input pin may also not be provided for each of switching circuit ICs 15*a* to 15*d*. As a result, a controller having a smaller size and fewer input pins can be constituted, and a cable having only one core is required for the temperature detection. Thus, the manufacturing costs can be reduced.

Figure 4:
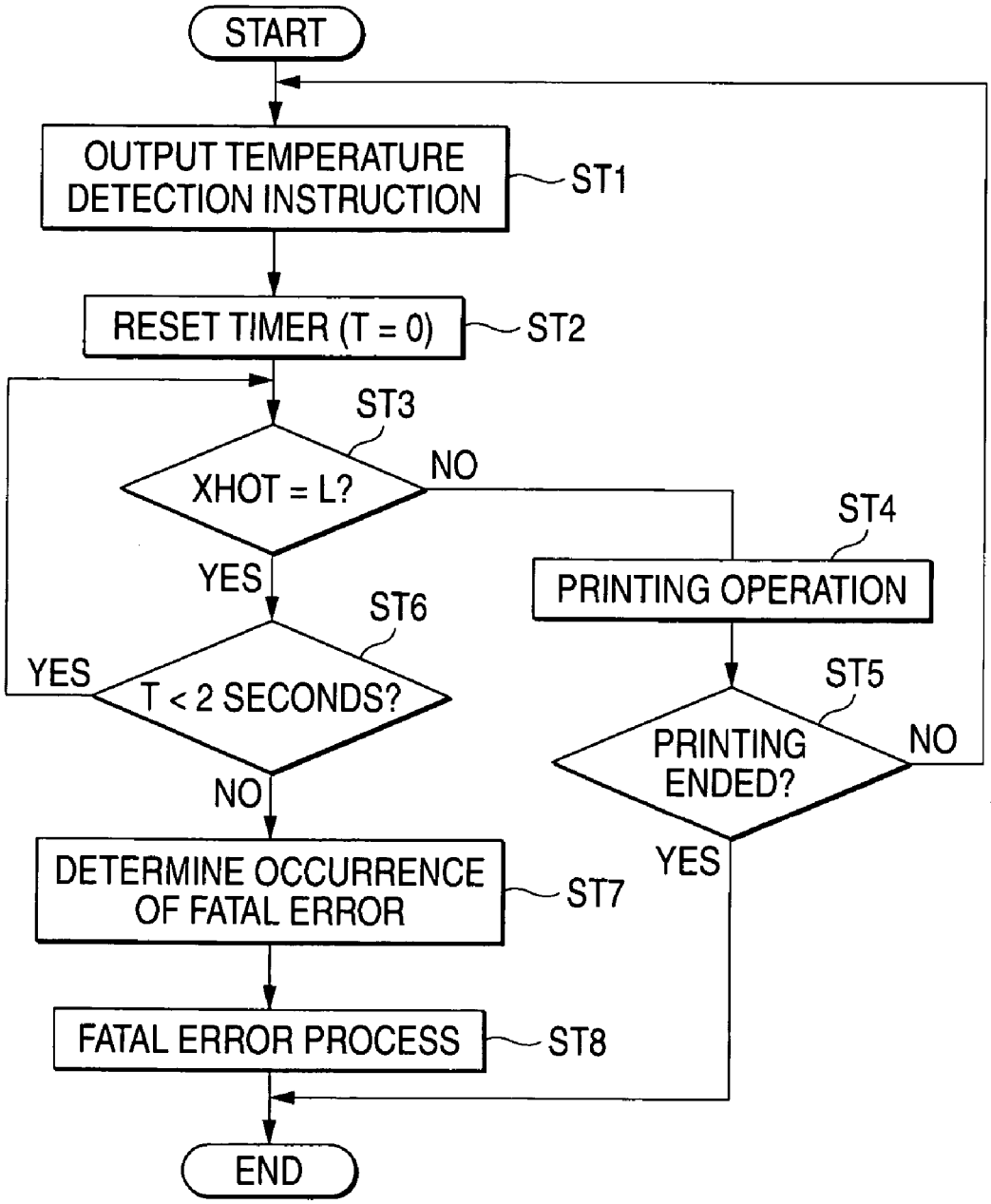
FIG. 4 is a flowchart showing the processing performed by the controller for the head driving device in FIG. 1.

When the controller 30 receives from the switching circuit IC 15 a digital signal for temperature detection (ST1), the controller 30 is operated as is shown in FIG. 4. FIG. 4 is a flowchart showing the process sequence performed immediately before the next printing pass is started.

At step ST2, the controller 30 resets an internal timer T to T=0. When at step ST3 the digital signals XHOT transmitted by the switching circuit ICs 15*a* to 15*d* via the cable 16 are at level H, the controller 30 assumes that the temperatures of the switching circuits 15*a* to 15*d* are a predetermined temperature or lower, and at step ST4, the controller 30 performs the printing operation. At step ST5, a check is performed to determine whether the printing has been completed. When the printing has been completed, the processing is terminated. When, however, the printing has not yet been completed, program control returns to step ST1.

When at step ST3 the digital signals XHOT are at level L, at step ST6 the controller 30 examines the timer count T. When the timer count T is smaller than two seconds, program control returns to step ST3.

In this manner, when the temperature of any switching circuit ICs 15*a* to 15*d* is raised to the predetermined temperature or higher, the controller 30 delays by two seconds the start of the printing operation, and waits until the temperature of the pertinent switching circuit IC 15*a* to 15*d* is less than the predetermined temperature.

When in two seconds the temperature of the switching circuit IC 15*a* to 15*d* drops to the predetermined temperature or lower, at step ST3, the digital signal XHOT goes to level H, and at step ST4, the printing operation is initiated.

On the other hand, when at step ST6 the timer count T is not smaller than two seconds, i.e., when two seconds have elapsed since a specific switching circuit IC 15*a* to 15*d* is raised to the predetermined temperature or higher, at step ST7, the controller 30 assumes that an abnormality has occurred in a circuit and that there has been a fatal error. At step ST8, the controller 30 performs the fatal error process, including the forcible printing termination, and halts the operation of the ink jet printer. The processing is thereafter terminated.

Figure 5:
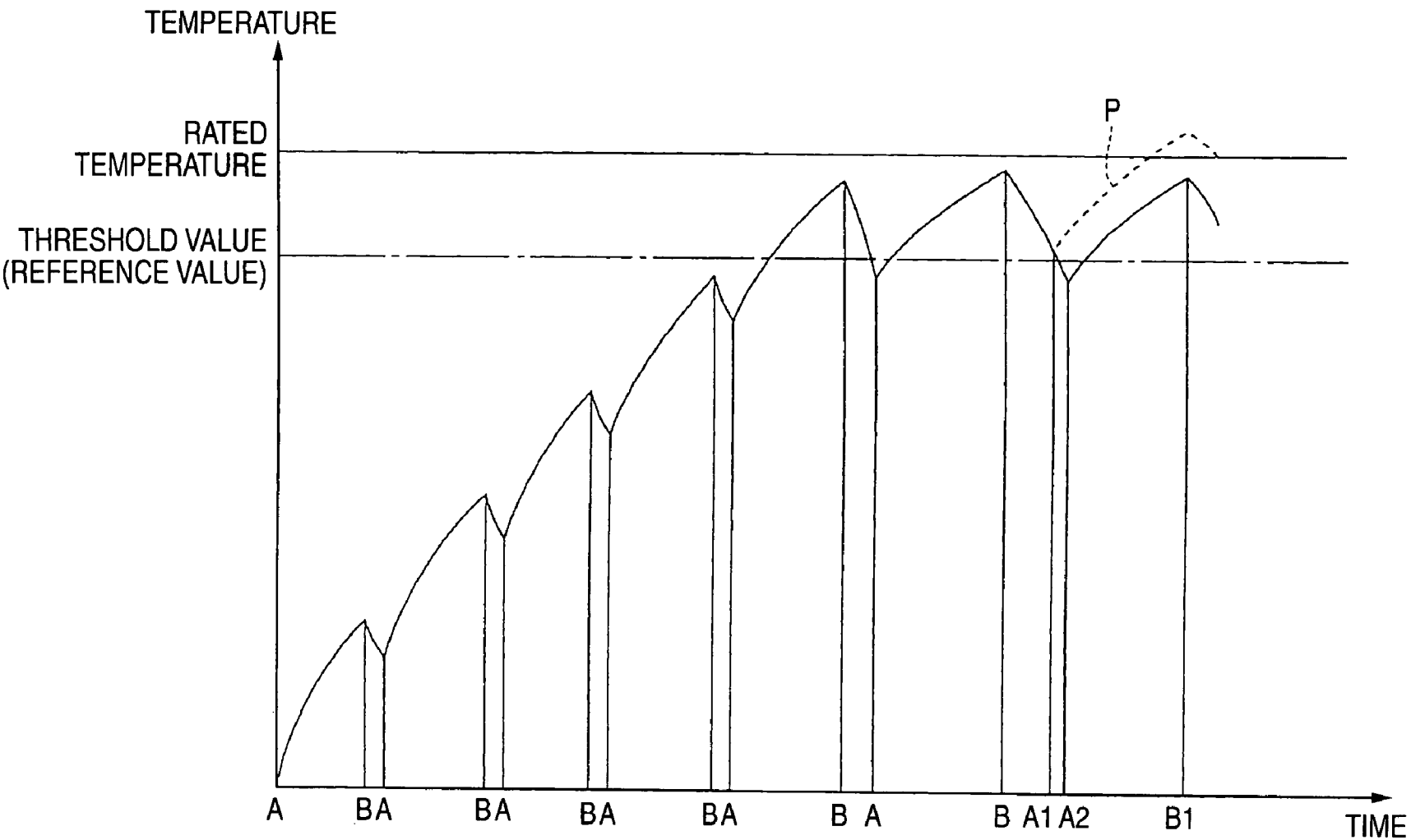
FIG. 5 is a graph showing the change in the temperature of the switching circuit IC when the printing operation is initiated by the head driving device in FIG. 1.
Figure 6:
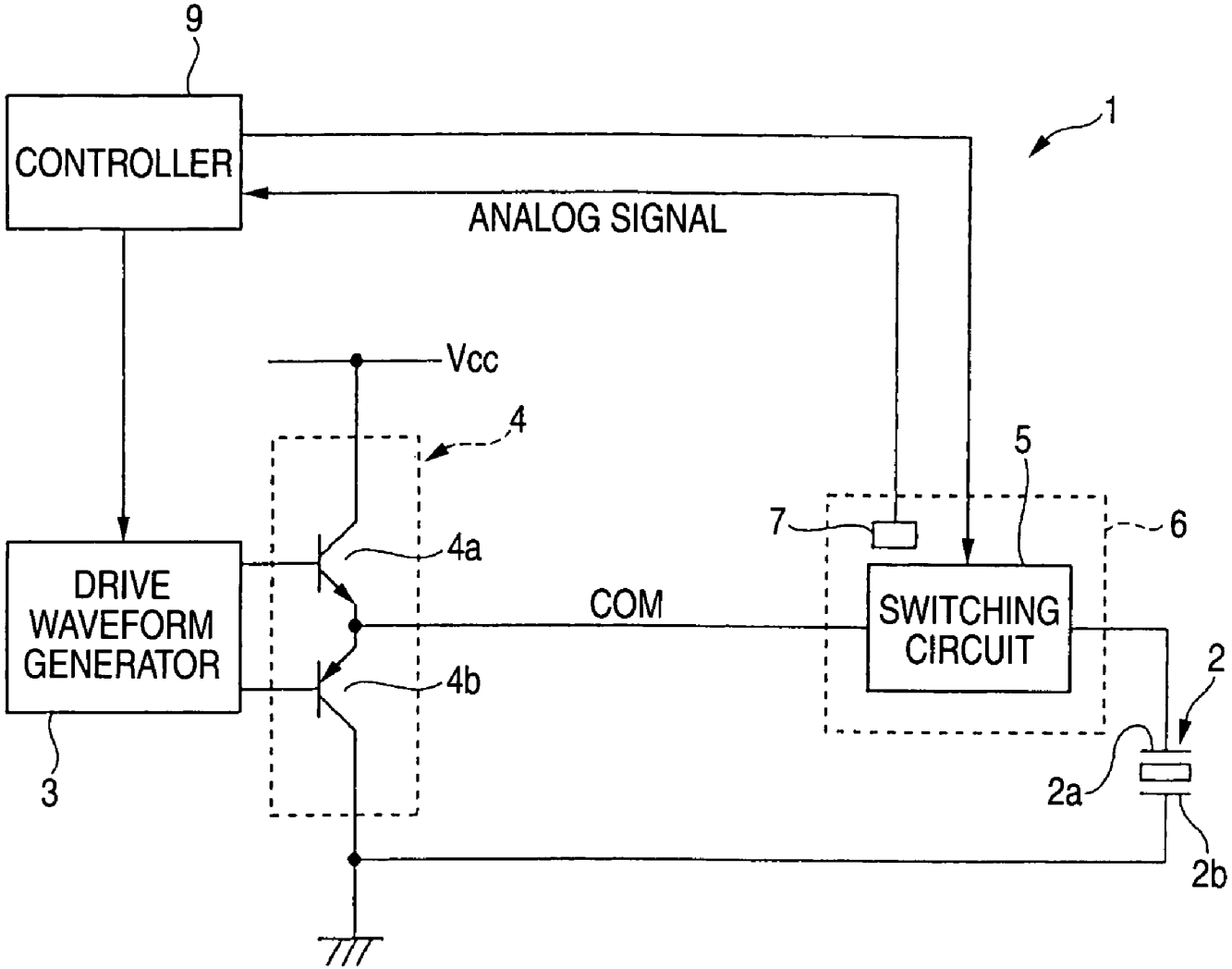
FIG. 6 is a block diagram showing an example configuration for a related head driving device for an ink jet printer.
Figure 7:
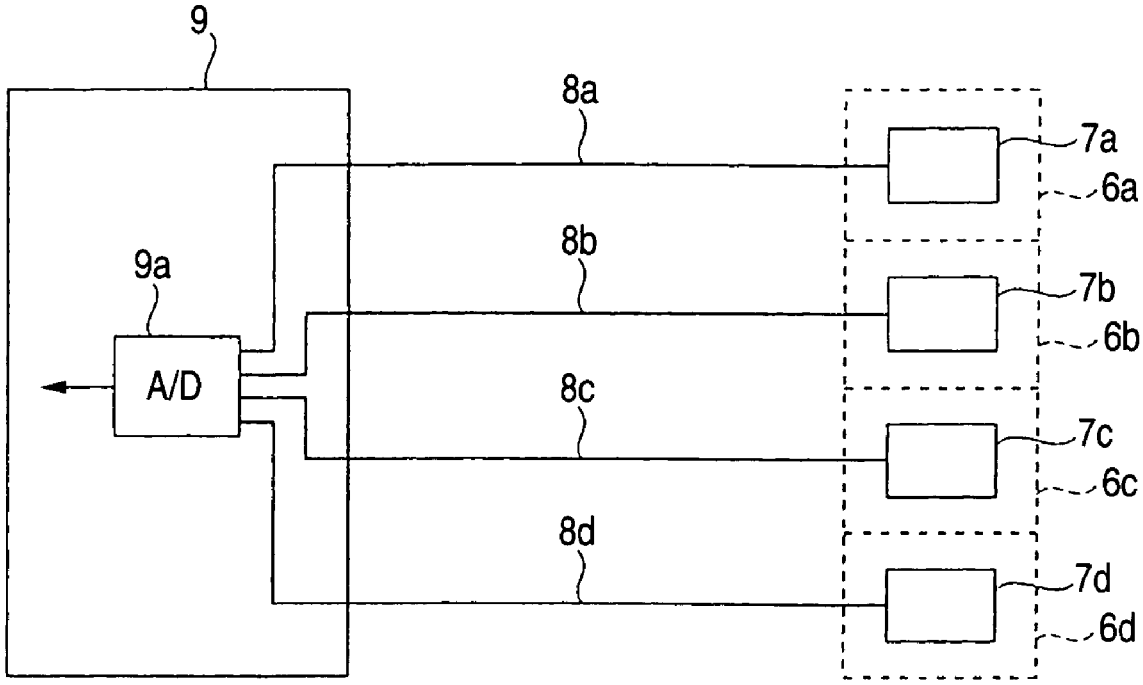
FIG. 7 is a block diagram showing an example arrangement for the switching circuit IC of the head driving device in FIG. 6.

The actual printing processing will now be explained while referring to the graph in FIG. 5. As is shown in the graph in FIG. 5, when the printing is started, heat is generated at every printing of each pass. At a pass start time A, the temperature of the switching circuit IC 15 is increased, and at a pass end time B, the temperature of the switching circuit IC is reduced by the discharge of heat during the printing halt period between the passes. When the printing passes are performed continuously, the temperature of the switching circuit IC 15 is gradually increased until it exceeds the threshold value.

When the temperature of the switching circuit IC 15 detected at the pass printing start time A is equal to or lower than the threshold value, the temperature of the switching circuit IC 15 is not increased by the rise in the temperature during the printing of the pass. Therefore, the printing is continued.

On the other hand, when the temperature of the switching circuit IC 15 detected at a pass printing start time A1 exceeds the threshold value, the printing is delayed for the maximum two seconds until the temperature of the switching circuit IC 15 drops to the threshold value. This is because, when the pertinent printing pass is sequentially performed, as is indicated by a broken line P, the temperature of the switching circuit IC 15 will be increased, so it exceeds the rated temperature, by the temperature rise during the printing pass.

When at time A2 the temperature of the switching circuit IC 15 falls to the threshold value or lower, the printing process is resumed and the printing pass is performed.

As is described above, according to the head driving device 10 of the invention, when the temperature detector 20 of the switching circuit IC 15 detects a temperature at the threshold value or higher, the temperature detector 20 changes the digital signal XHOT from level H to level L to notify the controller 30 of the temperature rise. Therefore, since the AD conversion process is not required to determine whether the temperature of the switching circuit IC 15 has reached a predetermined temperature, the controller 30 can rapidly perform the temperature detection process.

As a result, before each printing of a pass is started, the temperature of the switching circuit IC 15 can be detected without reducing the throughput. Further, while the heat generation at the switching circuit IC increases the ON resistance of the switching circuit, and the ON resistances for the analog switch of the switching circuit 14, which is included in each switching circuit IC 15, can be increased.

In addition, since the size of the IC can be reduced so long as the ON resistance can be increased, a switching circuit IC having a smaller size can be provided, at a low manufacturing cost.

In this embodiment, the head driving device 10 includes four switching circuit ICs 15*a* to 15*d*. However, it is apparent that the present invention can also be applied for a seven-color ink jet printer that includes seven switching circuits, or a monotone ink jet printer for which only one switching circuit is provided.

In the embodiment, the digital signals of the temperature detectors 20 for the switching circuit ICs 15*a* to 15*d* are transmitted through the single cable 16 to the controller 30. However, the digital signals from the switching circuit ICs 15*a* to 15*d* may also be transmitted through individual cables to the controller 30.

In this embodiment, for the temperature detectors 20 of the switching circuit ICs 15*a* to 15*d*, the digital signals obtained by the comparators 23 are transmitted through the FETs 24. However, the signals output by the comparators 23 may be transmitted directly to the controller 30 through a single cable 16 or individual cables.

What is claimed is:

1. A head driving device of a liquid ejecting apparatus, comprising:

a plurality of nozzles;

a head driving circuit, generating driving signals;

a plurality of pressure generating elements, correspondingly provided for each of the nozzles, and applying pressure to liquid based on the driving signals so that liquid droplets are ejected from the nozzles;

an integrated switching circuit, selecting the driving signals for applying to the pressure generating elements at predetermined ejecting timing;

a controller, controlling a liquid ejecting operation; and a thermal detector, provided in the integrated switching circuit, and detecting a temperature of the integrated switching circuit, wherein the thermal detector outputs a digital signal to the controller when the temperature of the integrated switching circuit is increased to greater than a predetermined temperature; and wherein the controller halts the liquid ejecting operation when the controller receives the digital signal.

2. The head driving device as set forth in claim 1, wherein the controller defers a start of the halted liquid ejecting operation until the temperature of the integrated switching circuit is reduced to a specific temperature when the controller receives the digital signal.

3. The head driving device as set forth in claim 1, wherein a diode is provided in the integrated switching circuit; and wherein the thermal detector detects the temperature of the integrated switching circuit based on an anode voltage of the diode.

4. The head driving device as set forth in claim 3, wherein the temperature detector includes:

a temperature setting unit, setting a reference voltage that corresponds to a reference temperature of the integrated switching circuit; and a comparator, comparing the anode voltage of the diode with the reference voltage, and outputting the digital signal to the controller when the anode voltage of the diode is increased to greater than the reference voltage.

5. The head driving device as set forth in claim 4, wherein a plurality of the integrated switching circuits are provided for each group of nozzles; and wherein the digital signals output from the comparators of the integrated switching circuits are independently transmitted to the controller.

6. The head driving device as set forth in claim 4, wherein the integrated switching circuit includes a FET;

wherein the digital signal output from the comparator is received at a gate of the FET; and an output terminal of the FET is an open-drain.

7. The head driving device as set forth in claim 6, wherein a plurality of the integrated switching circuits are provided for each group of nozzles; and wherein the digital signals output from the open-drains of the FETs of the integrated switching circuits are independently transmitted to the controller.

8. The head driving device as set forth in claim 6, wherein a plurality of the integrated switching circuits are provided for each group of nozzles;

wherein the digital signals output from the open-drains of the FETs of the integrated switching circuits are combined as AND operation; and wherein the combined digital signal is transmitted through a single cable to the controller.

9. The head driving device as set forth in claim 1, wherein the thermal detector detects the temperature of the integrated switching circuit each time a liquid ejecting of a pass is started.

* * * * *